US012071210B2

(12) United States Patent
Hao et al.

(10) Patent No.: US 12,071,210 B2
(45) Date of Patent: Aug. 27, 2024

(54) THRUST REVERSAL EMERGENCY JETTISON DEVICE FOR UNDERWATER VEHICLE

(71) Applicant: INSTITUTE OF OCEANOGRAPHIC INSTRUMENTATION, SHANDONG ACADEMY OF SCIENCES, Shandong (CN)

(72) Inventors: Zongrui Hao, Shandong (CN); Lu Dong, Shandong (CN); Fanpu Meng, Shandong (CN); Wanlong Ren, Shandong (CN); Yue Wang, Shandong (CN); Gang Liu, Shandong (CN); Zhili Hua, Shandong (CN); Juan Xu, Shandong (CN)

(73) Assignee: INSTITUTE OF OCEANOGRAPHIC INSTRUMENTATION, SHANDONG ACADEMY OF SCIENCES, Shandong (CN)

( * ) Notice: Subject to any disclaimer, the term of this patent is extended or adjusted under 35 U.S.C. 154(b) by 0 days.

(21) Appl. No.: 18/378,494

(22) Filed: Oct. 10, 2023

(65) Prior Publication Data

US 2024/0034448 A1 Feb. 1, 2024

(30) Foreign Application Priority Data

Oct. 11, 2022 (CN) ..... 202211237247.6

(51) Int. Cl.
*B63G 8/24* (2006.01)

(52) U.S. Cl.
CPC ..... *B63G 8/24* (2013.01)

(58) Field of Classification Search
CPC . B63G 8/00; B63G 8/001; B63G 8/24; B63G 8/40; B63G 8/41

(Continued)

(56) References Cited

U.S. PATENT DOCUMENTS 2,115,996 A * 5/1938 Mckenney ..... B63C 7/26 114/328
3,322,088 A * 5/1967 Harada ..... B63B 22/08 114/54

(Continued)

FOREIGN PATENT DOCUMENTS

CN 107054594 A 8/2017
CN 206826898 U 1/2018

(Continued)

OTHER PUBLICATIONS

CNIPA, Notification of First Office Action for Chinese application CN202211237247.6, Nov. 25, 2022.

(Continued)

*Primary Examiner* — Daniel V Venne
(74) *Attorney, Agent, or Firm* — MUNCY, GEISSLER, OLDS & LOWE, PC

(57) ABSTRACT

A thrust reversal emergency jettison device for an underwater vehicle includes a thrust reversal mechanism. The thrust reversal mechanism includes a casing and a gas reaction compartment provided in the casing; the gas reaction compartment communicates with a gas passage in a shell of the casing through a gas pipe; and a bottom end cover is provided at a bottom of the gas reaction compartment, and the bottom end cover is hermetically connected with the gas reaction compartment through a cylinder mechanism, and falls off automatically when a gas pressure in the gas reaction compartment increases. Compared with the prior art, the present invention can provide a reverse thrust for an underwater vehicle in an emergency, help the underwater vehicle to ascend, and improve safety.

5 Claims, 12 Drawing Sheets

(58) Field of Classification Search
USPC ..... 114/312, 313, 322, 336, 44, 50
See application file for complete search history.

(56) References Cited

U.S. PATENT DOCUMENTS

| | | | |
|---|---|---|---|
| 3,613,616 | A | 10/1971 | Basset |
| 2007/0283871 | A1 | 12/2007 | Millum et al. |
| 2013/0291781 | A1 | 11/2013 | Myers |
| 2018/0001981 | A1 | 1/2018 | Boss |

FOREIGN PATENT DOCUMENTS

| | | | | |
|---|---|---|---|---|
| CN | 109552578 | A | 4/2019 | |
| CN | 112319749 | A | 2/2021 | |
| CN | 114475994 | A | 5/2022 | |
| EP | 2487104 | A1 * | 8/2012 | ..... B63G 8/30 |

OTHER PUBLICATIONS

CNIPA, Notification to grant patent right for Chinese application CN202211237247.6, Jan. 5, 2023.

* cited by examiner

THRUST REVERSAL EMERGENCY JETTISON DEVICE FOR UNDERWATER VEHICLE

TECHNICAL FIELD

The present invention belongs to the technical field of subsea equipment, and specifically pertains to a thrust reversal emergency jettison device for an underwater vehicle.

BACKGROUND

The development and utilization of marine resources has become a hot topic of research in various countries around the world. Underwater vehicles are an important underwater tool to explore and salvage underwater targets, and widely used in marine environment monitoring, resource exploration, marine archaeology, etc. An emergency jettison device is an important device that enables the underwater vehicle to ascend in an emergency such as water leakage and loss of control during operation. It is extremely important for various underwater vehicles.

In practical application, the underwater vehicle performs underwater search or salvage. When water leakage or power out of control occurs, the underwater vehicle will be trapped in bottom sediment. The traditional underwater emergency jettison is carried out by jettison the counterweight load only to reduce dead weight to produce buoyancy force, but the buoyancy force is limited and cannot pull the underwater vehicle out of the sediment, especially in the case of loss of power which often results in destruction or even loss of the underwater vehicle. Therefore, how to prevent underwater vehicles from being trapped in sediment and ensure safety of the underwater vehicle in an emergency is an urgent problem to be solved during underwater operation.

SUMMARY

The present invention proposes a novel thrust reversal emergency jettison device which draws seawater into a gas reaction compartment by means of a low pressure to generate a high-pressure gas in the gas reaction compartment, uses the high-pressure gas to unhook a counterweight load of the device, injects the high-pressure gas from the bottom at the same time to provide a reverse thrust, and gives an upward reverse thrust to an underwater vehicle while jettison the counterweight, so that the underwater vehicle can also get rid of sediment in the case of power loss and urgently ascends, thereby improving safety and reliability of the underwater vehicle.

The technical solution adopted by the present invention to solve the technical problem is as follows: a thrust reversal emergency jettison device for an underwater vehicle, comprises a thrust reversal mechanism, the thrust reversal mechanism comprises a casing and a gas reaction compartment provided in the casing; the gas reaction compartment communicates with a gas passage in the casing through a gas pipe; and a bottom end cover is provided at a bottom of the gas reaction compartment, and the bottom end cover is hermetically connected with the gas reaction compartment through a cylinder mechanism, and falls off automatically when a gas pressure in the gas reaction compartment increases.

Preferably, the cylinder mechanism is fixed on the bottom end cover, and comprises a gas chamber and more than two first piston barrels provided circumferentially around the gas chamber; a first piston is provided in the first piston barrel, and a clamping block is connected to an outer end of the first piston; and a bottom inner wall of the gas reaction compartment is provided with a clamping groove, and the first piston extends or retracts along the first piston barrel under the action of the gas pressure, thereby connecting/separating the clamping block with/from the clamping groove.

Preferably, an upper end face of the bottom end cover is provided with an annular axial baffle; an outer wall of the axial baffle is provided with an axial sealing ring; the upper end face of the bottom end cover is provided with a radial sealing ring, and a middle portion of the bottom end cover is provided with an air hole in communication with the gas reaction compartment; and a cylinder bracket is provided in the axial baffle.

Preferably, a top end cover is hermetically connected to a top of the gas reaction compartment; and the top end cover is provided with an opening, and a one-way normally open solenoid valve is mounted at the opening.

Preferably, the thrust reversal emergency jettison device further comprises a counterweight load; and the counterweight load is detachably assembled to an outer portion of the thrust reversal mechanism through a piston connecting rod mechanism.

Preferably, the piston connecting rod mechanism comprises a second piston and a second piston barrel, and the second piston barrel is connected with an inner wall of the casing and communicates with the gas passage in the shell of the casing; an outer end of the second piston is connected to a short connecting rod; the other end of the short connecting rod is connected with a long connecting rod, the short connecting rod is shorter than long connecting rod, an upper end of the long connecting rod is fixed by a rotating shaft, and a lower end is provided with a hook plate; and the second piston extends or retracts along the second piston barrel under the action of the gas pressure, thereby driving the long connecting rod to rotate around an axis.

Preferably, the hook plate is hinged to the lower end of the long connecting rod; a limiting baffle is provided below the hook plate; a chute with a downward opening is provided at a bottom of the casing; and the hook plate and the chute are respectively provided with magnetic surfaces with a same magnetism, and the hook plate rotates downwards to open under the action of repulsion of the same magnetism.

Preferably, the counterweight load is a shell structure with two open ends, an inner wall thereof is provided with an annular groove, and the annular groove is in fit with the hook plate for fixing.

Compared with the prior art, the present invention can provide a reverse thrust for an underwater vehicle in an emergency, help the underwater vehicle to ascend, prevent the underwater vehicle from being trapped in bottom sediment, and improve safety.

Figure 1:
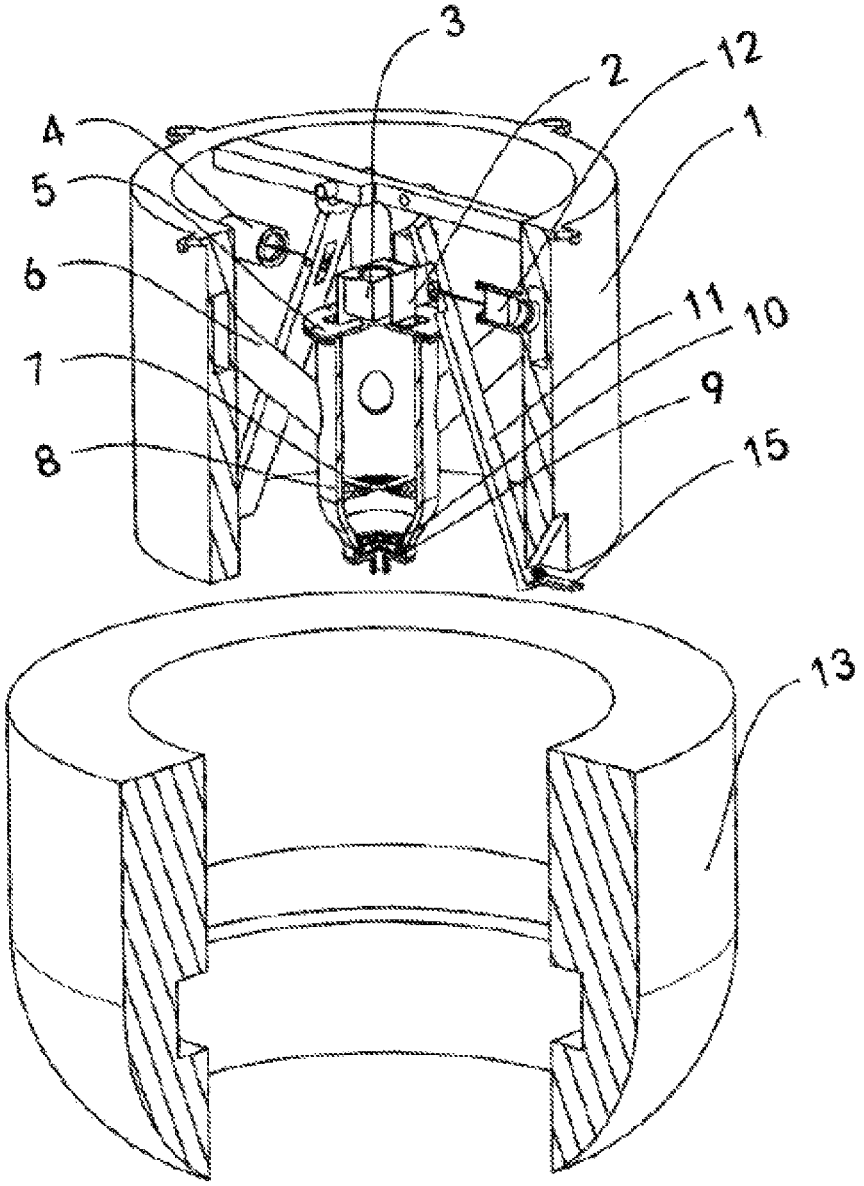
FIG. 1 is an overall structural schematic view of a thrust reversal emergency jettison device for an underwater vehicle according to an embodiment of the present invention.

Reference numerals in the drawings: 1: casing; 2: solenoid valve holder; 3: one-way normally open solenoid valve; 4: second piston barrel; 5: top end cover; 6: gas pipe; 7: isolation mesh: 8: gas reaction compartment: 9: bottom end cover; 10: four-way cylinder; 11: long connecting rod; 12: second piston; 13: counterweight load; 14: triangular clamping block; 15: hook plate; 16: limiting flange; 17: cylinder frame;

1-1: mounting hole; 1-2: gas passage; 1-3: beam; 1-4: shaft hole; 1-5: triangular chute; 1-6: magnetic bevel;

2-1: through hole; 2-2: solenoid valve clamping groove; 2-3: center hole;

4-1: limiting flange fixing hole; 4-2: piston limiting block;

5-1: flange fixing hole; 5-2: solenoid valve fixing hole; 5-3: solenoid valve connection port; 5-4: sealing ring groove;

7-1: isolation mesh stiffener; 7-2: fixing hole; 7-3: mesh surface;

8-1: top end cover fixing hole; 8-2: top flange; 8-3: isolation mesh fixing plate; 8-4: isolation mesh fixing hole; 8-5: bottom constriction port; 8-6: bottom sealing port; 8-7: clamping groove;

9-1: air hole; 9-2: axial sealing ring; 9-3: radial sealing ring; 9-4: axial baffle; 9-5: first limiting block; 9-6: cylinder bracket; 9-7: baffle groove; 9-8: fixed cylinder column;

10-1: first piston; 10-2: first piston barrel; 10-3: gas chamber; 10-4: triangular clamp fixing groove;

11-1: hollow rotating shaft; 11-2: pin hole; 11-3: rod body groove; 11-4: rod body; 11-5: rotating shaft fixing hole; 11-6: limiting baffle;

12-1: piston body; 12-2: short connecting rod; 12-3: snap ring;

13-1: annular groove;

14-1: fixing column; 14-2: bevel;

15-1: rotating shaft hole; 15-2: magnetic surface;

17-1: gas chamber fixing hole; 17-2: second limiting block; 17-3: piston barrel fixing plate; 17-4: cylinder frame fixing hole.

DESCRIPTION OF THE EMBODIMENTS

In order to facilitate understanding of the present invention, the present invention will be described in more detail below with reference to the accompanying drawings and specific embodiments. Preferred embodiments of the present invention are shown in the drawings. The present invention may, however, be embodied in many different forms, and should not be construed as limited to the embodiments set forth herein. Rather, these embodiments are provided to enable the disclosure to be understood thoroughly and completely.

The present embodiment provides a thrust reversal emergency jettison device for an underwater vehicle, as shown in FIG. 1, which is mainly composed of an upper thrust reversal mechanism and a lower counterweight load. The thrust reversal mechanism is fixed to a bottom of the underwater vehicle by bolting, and the counterweight load is detachably assembled to an outer portion and a lower portion of the thrust reversal mechanism.

Figure 2:
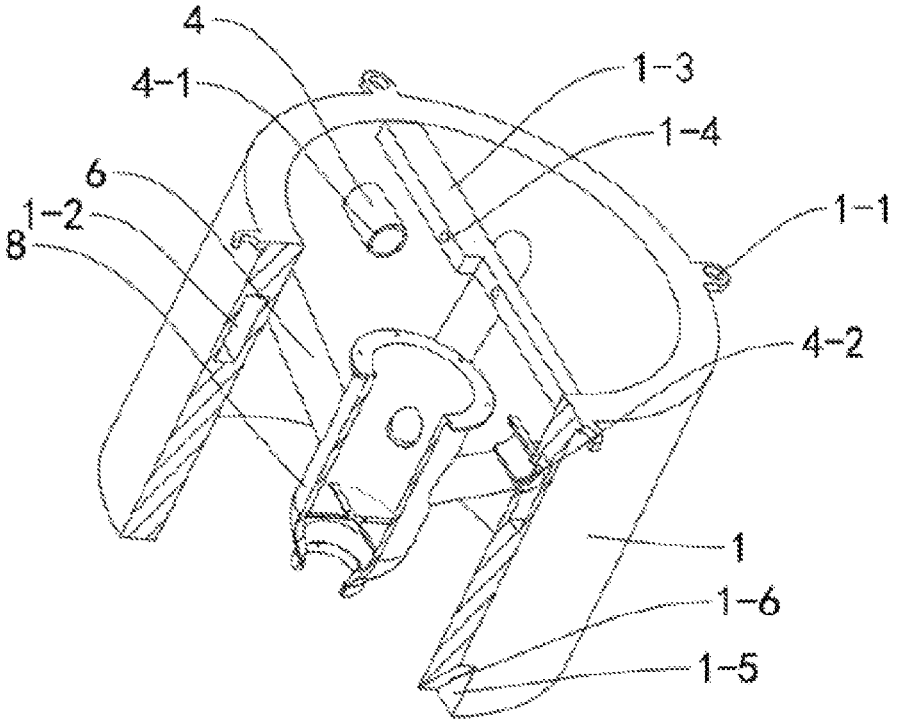
FIG. 2 is a structural schematic view of a thrust reversal mechanism.

As shown in FIGS. 1 and 2, the thrust reversal mechanism mainly comprises a casing 1 and a gas reaction compartment 8. The gas reaction compartment 8 is suspended inside the casing 1 and connected with the casing 1 by four gas pipes 6 arranged circumferentially. The casing 1 comprises a mounting hole 1-1, a gas passage 1-2 and a beam 1-3. The beam 1-3 is arranged at a top of the casing 1 and is provided with a shaft hole 1-4. The thrust reversal mechanism can be fixed to the bottom of the underwater vehicle by means of the mounting hole 1-1 on the casing 1 and a bolt. A gas passage 1-2 is provided in a shell of the casing 1, and the gas passage 1-2 is an annular channel. One end of the gas pipe 6 is connected with the gas reaction compartment 8, and the other end thereof is connected with the gas passage 1-2, forming a gas flow channel together.

A second piston barrel 4 is also connected to an inner wall of the casing 1 and communicates with the gas passage 1-2, and a second piston 12 is assembled in the second piston barrel 4. A piston limiting block 4-2 is provided at a connection between the second piston barrel 4 and the gas passage 1-2 for the purpose of limiting a range of an inward movement of the second piston 12. An outer end of the second piston barrel 4 is provided with a limiting flange fixing hole 4-1 which is in fit a limiting flange 16 to limit a range of an outward movement of the second piston 12 and prevent the piston from falling out. Two symmetrical triangular chutes 1-5 are provided at a lower end of the casing 1, and the triangular chutes 1-5 have magnetic bevels 1-6 therein.

Figure 3:
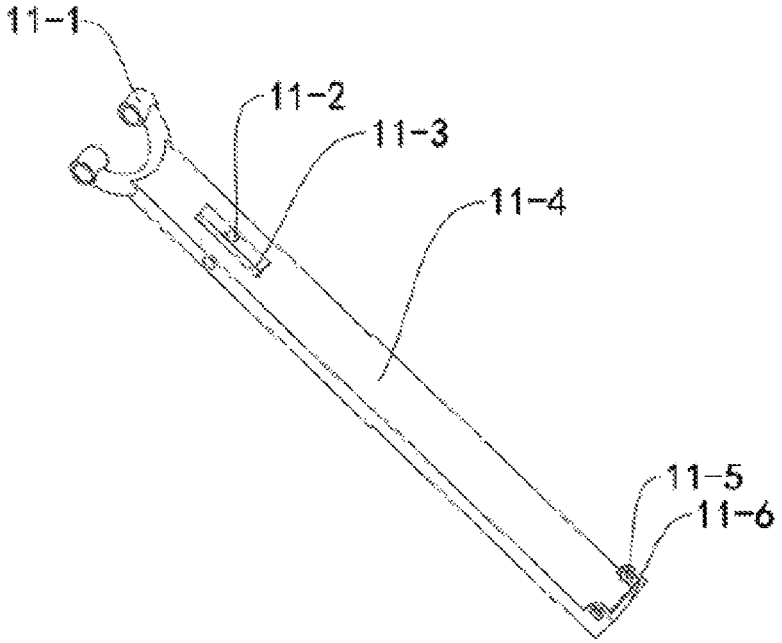
FIG. 3 is a structural schematic view of a long connecting rod.

As shown in FIG. 3, a long connecting rod 11 is mainly composed of a hollow rotating shaft 11-1, a pin hole 11-2, a rod body groove 11-3, a rod body 11-4, a rotating shaft fixing hole 11-5 and a limiting baffle 11-6. The hollow rotating shaft 11-1 has a symmetrical cylindrical shape, is clamped on the beam 1-3 in the middle, and is in fit with the shaft hole 1-4 on the beam 1-3 through a pin, and the long connecting rod 11 can rotate around the shaft hole 1-4. The rod body 11-4 is provided with a rod body groove 11-3, a pin hole 11-2 is provided in the middle of the rod body groove 11-3, and a pin in the pin hole 11-2 is in fit with a snap ring 12-3 of the second piston 12. A rotating shaft fixing hole 11-5 and a limiting baffle 11-6 are provided at a tail end of the rod body 11-4, the rotating shaft fixing hole 11-5 is in fit with a rotating shaft hole 15-1 of a hook plate 15, and the limiting baffle 11-6 at a lowest end limits the hook plate 15 in terms of an angle of rotation.

Figure 4:
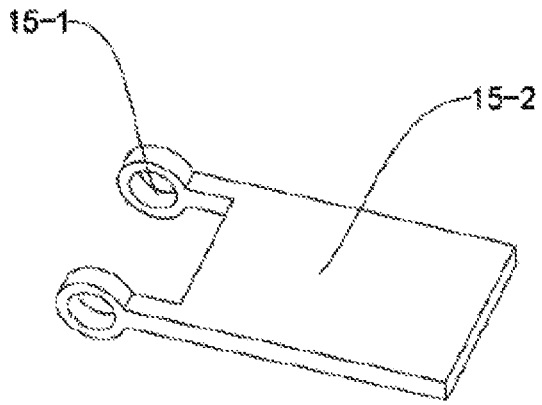
FIG. 4 is a schematic view of a hook plate.

As shown in FIG. 4, the hook plate 15 is mainly composed of a rotating shaft hole 15-1 and a magnetic surface 15-2, and the rotating shaft hole 15-1 is in fit with the rotating shaft fixing hole 11-5 through a pin, so that the hook plate 15 can rotate along a pin in the rotating shaft fixing hole 11-5. The magnetic surface 15-2 and the magnetic bevels 1-6 in the triangular chutes 1-5 are of the same polarity.

Figure 5:
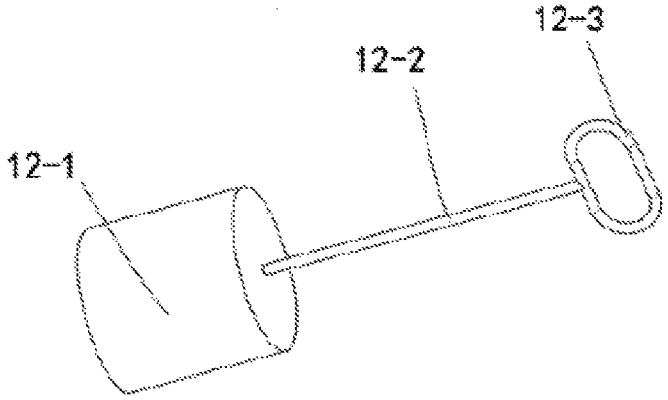
FIG. 5 is a schematic view of a connection between a second piston and a short connecting rod.
Figure 6:
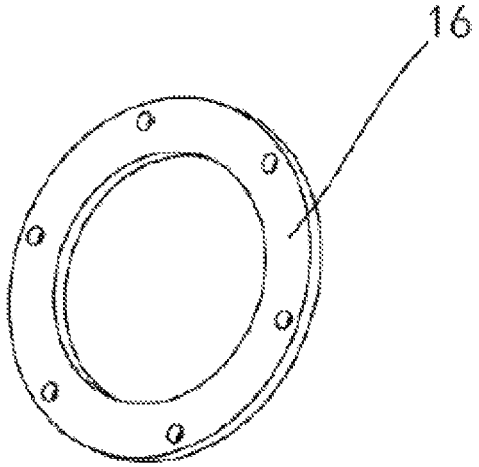
FIG. 6 is a structural schematic view of a limiting flange.

As shown in FIG. 5, a piston body 12-1 of the second piston 12 is connected with the snap ring 12-3 through a short connecting rod 12-2. The snap ring 12-3 is fitted over the pin in the pin hole 11-2. The structure of the limiting flange 16 is as shown in FIG. 6, an inner diameter thereof is smaller than an inner diameter of the second piston barrel 4, and the limiting flange is in fit with the limiting flange fixing hole 4-1 to be fixed on an outer portion of the second piston barrel 4 and limit the piston body 12-1.

Figure 7:
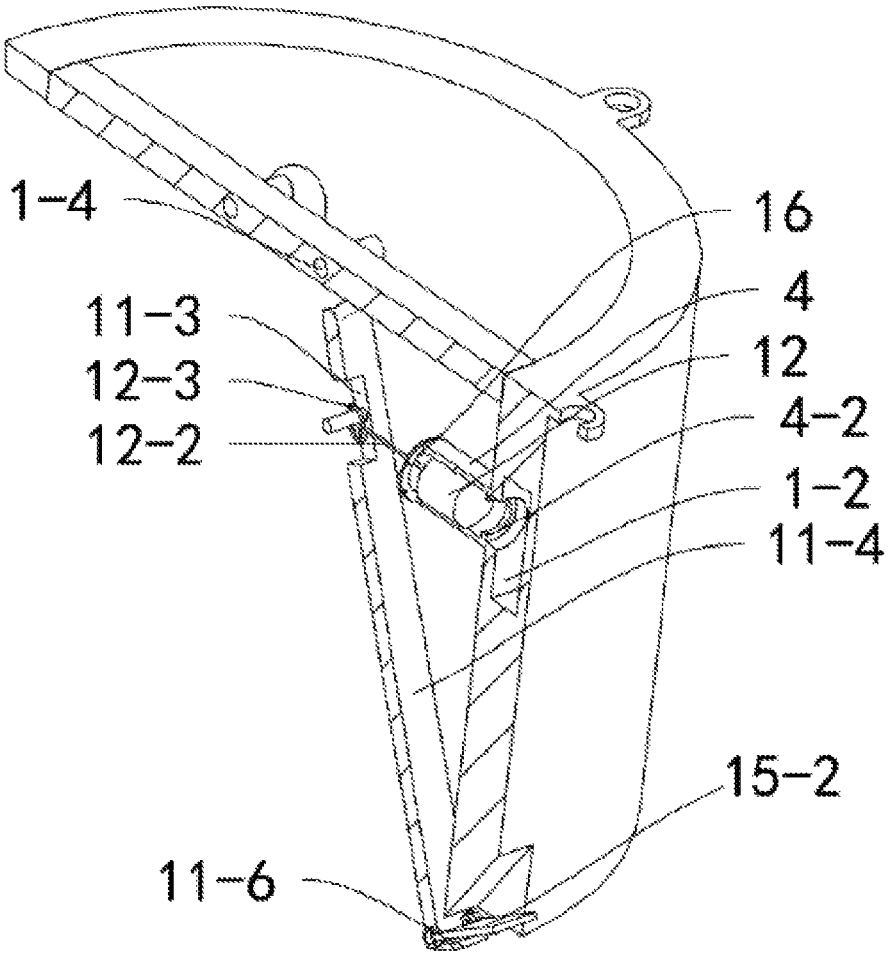
FIG. 7 is a partial detail view of a piston connecting rod mechanism.

As shown in FIG. 7, in the present embodiment, the long connecting rod 11, the second piston 12, the second piston barrel 4, the short connecting rod 12-2, the snap ring 12-3, and the pin in the pin hole 11-2 together constitute a piston connecting rod mechanism. Since the second piston barrel 4 communicates with the gas passage 1-2, when a difference between a gas pressure in the gas reaction compartment 8 and a gas pressure outside the gas reaction compartment changes, the second piston is driven to extend or retract by the gas pressure, and then the long connecting rod 11 is driven to rotate around the pin in the shaft hole 1-4 by the short connecting rod 12-2 and the snap ring 12-3.

Figure 8:
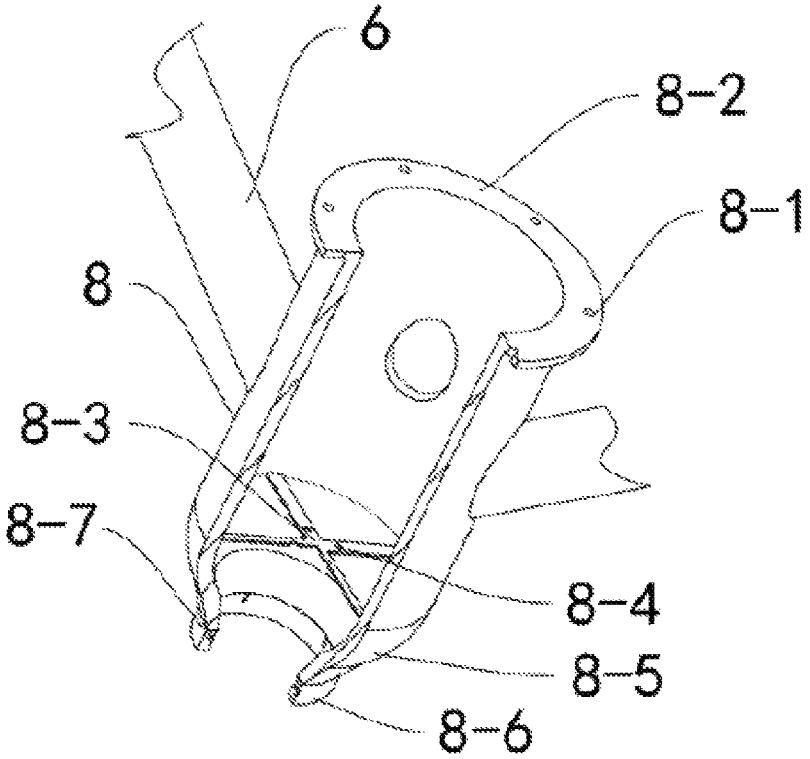
FIG. 8 is a structural schematic view of a gas reaction compartment.

As shown in FIG. 8, the gas reaction compartment 8 comprises a top flange 8-2, an isolation mesh fixing plate 8-3, an isolation mesh fixing hole 8-4, a bottom constriction port 8-5, a bottom sealing port 8-6, and a clamping groove 8-7. A top end cover fixing hole 8-1 on the top flange 8-2 is in fit with a flange fixing hole 5-1 of a top end cover 5 to fix the top end cover 5. The isolation mesh fixing plate 8-3 in the gas reaction compartment 8 is used to receive an isolation mesh 7 and is fixed by fit between the isolation mesh fixing hole 8-4 and a fixing hole 7-2 of the isolation mesh 7. A lower end of the gas reaction compartment 8 has a bottom constriction port 8-5, and the bottom sealing port 8-6 is connected with a lower end of the bottom constriction port 8-5. A clamping groove 8-7 is provided on an inner wall of the bottom sealing port 8-6 in four directions.

In the present embodiment, a substance capable of reacting with water to generate gas, such as alkali metal sodium, lithium, etc. or calcium carbide, is placed on the isolation mesh 7 in the gas reaction compartment 8. A large amount of gas is generated in the gas reaction compartment 8 through chemical reaction, and since the gas reaction compartment is a closed compartment body, a pressure in the compartment is greater than a pressure outside the compartment. The high-pressure gas in the compartment is used as a power source for subsequent reverse thrust.

Figure 9:
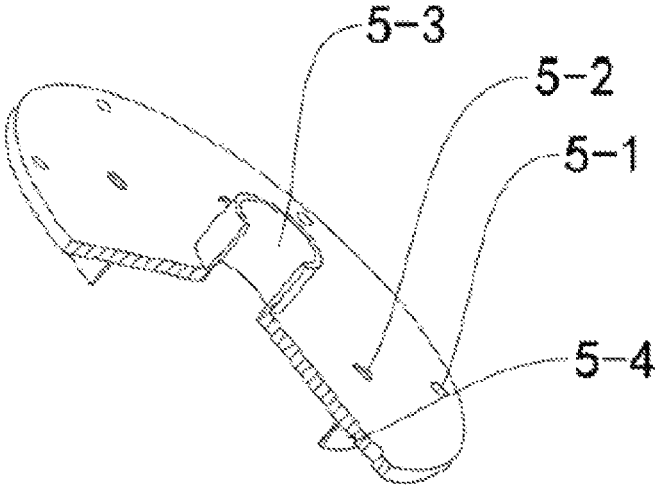
FIG. 9 is a schematic view of a top end cover.

As shown in FIG. 9, the top end cover 5 mainly comprises the flange fixing hole 5-1, a solenoid valve fixing hole 5-2, a solenoid valve connection port 5-3 and a sealing ring groove 5-4. The flange fixing hole 5-1 is in fit with the top end cover fixing hole 8-1 of the top flange 8-2 to fix the top end cover 5 on the gas reaction compartment 8 and perform sealing through a sealing ring in the sealing ring groove 5-4. The solenoid valve fixing hole 5-2 is in fit with a through hole 2-1 of a solenoid valve holder 2 to fix the solenoid valve holder 2, and the solenoid valve connection port 5-3 is connected to a one-way normally open solenoid valve 3.

Figure 10:
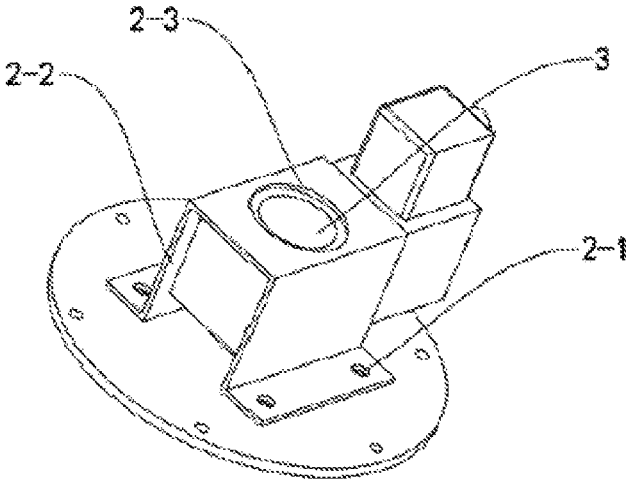
FIG. 10 is a schematic view of a solenoid valve holder.

As shown in FIG. 10, the solenoid valve holder 2 comprises the through hole 2-1, a solenoid valve clamping groove 2-2 and a center hole 2-3. A water outlet of the one-way normally open solenoid valve 3 is connected with the solenoid valve connection port 5-3, and a water inlet thereof is connected outside the compartment through the center hole 2-3. The through hole 2-1 is in fit with the solenoid valve fixing hole 5-2 through a bolt to fix the solenoid valve holder 2 on the top end cover 5, and to clamp the one-way normally open solenoid valve 3 in the solenoid valve clamping groove 2-2. A control line of the one-way normally open solenoid valve 3 is led out from one side of the solenoid valve clamping groove 2-2.

Figure 11:
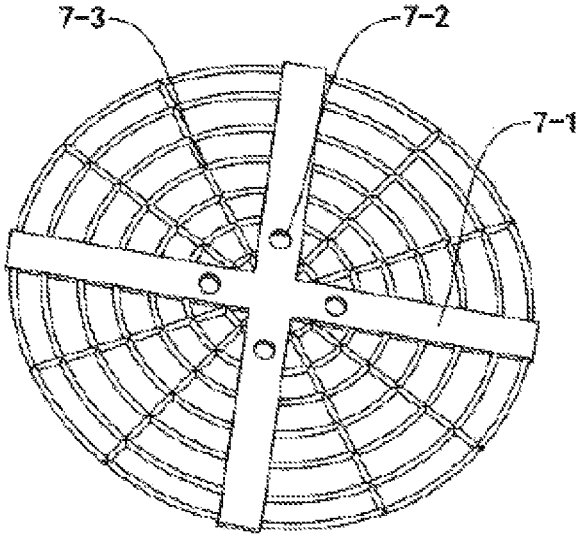
FIG. 11 is a schematic view of an isolation mesh.

As shown in FIG. 11, the isolation mesh 7 is mainly composed of a mesh surface 7-3 and an isolation mesh stiffener 7-1. A fixing hole 7-2 is provided on the isolation mesh stiffener 7-1, and the fixing hole 7-2 is in fit with the isolation mesh fixing hole 8-4 through a bolt to fix the isolation mesh 7 on the isolation mesh fixing plate 8-3.

Figure 12:
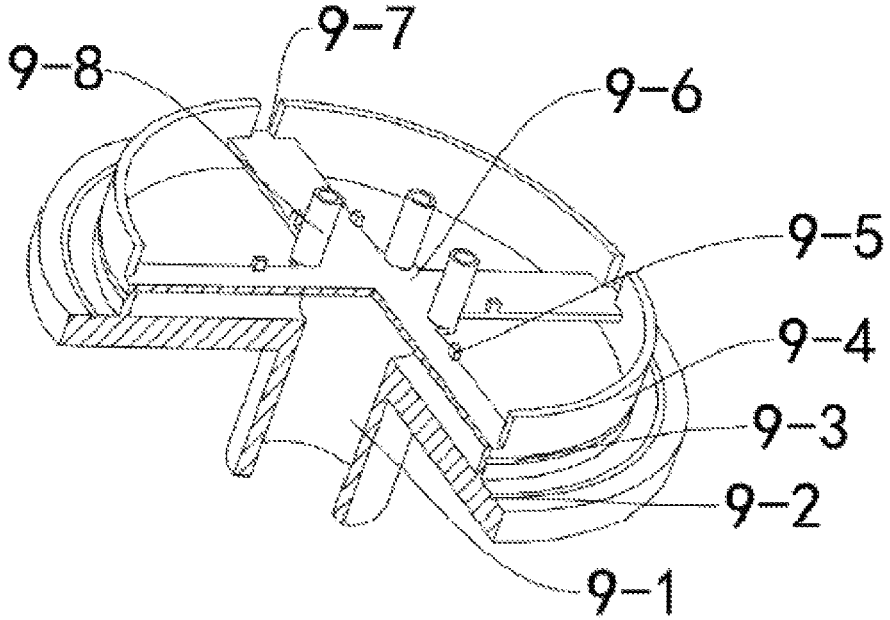
FIG. 12 is a schematic view of a bottom head cover.

As shown in FIG. 12, a bottom end cover 9 comprises an air hole 9-1, an axial sealing ring 9-2, a radial sealing ring 9-3, an axial baffle 9-4, a first limiting block 9-5, a cylinder bracket 9-6, a baffle groove 9-7 and a fixed barrel column 9-8. The air hole 9-1 communicates the gas reaction compartment 8 with the outside, and a check valve is connected to an outside thereof. The axial sealing ring 9-2 and the radial sealing ring 9-3 ensure a watertight connection between the bottom end cover 9 and the bottom sealing port 8-6. An annular axial baffle 9-4 is provided on an inside of the bottom end cover 9, an outer diameter thereof is adapted to an inner diameter of the bottom sealing port 8-6. The axial baffle 9-4 has baffle grooves 9-7 in four directions which correspond to the clamping grooves 8-7. A cylinder bracket 9-6 is provided in the axial baffle plate 9-4, and the cylinder bracket 9-6 is provided with a first limiting block 9-5 in four directions to limit movement of a four-way cylinder 10. The cylinder bracket 9-6 is further provided with a fixed cylinder column 9-8 in four directions which is in fit with a cylinder frame 17 to fix the four-way cylinder 10.

Figure 13:
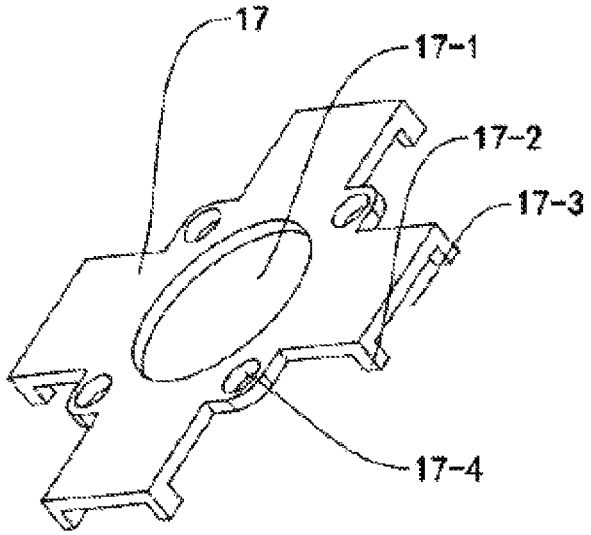
FIG. 13 is a schematic view of a cylinder frame.

As shown in FIG. 13, the cylinder frame 17 mainly comprises a gas chamber fixing hole 17-1, a piston barrel fixing plate 17-3 and a cylinder frame fixing hole 17-4. A tail end of the piston barrel fixing plate 17-3 is provided with a second limiting block 17-2 for the purpose of limiting the four-way cylinder 10. The cylinder frame fixing hole 17-4 is in fit with the fixed cylinder column 9-8 to fix the cylinder frame 17.

Figure 14:
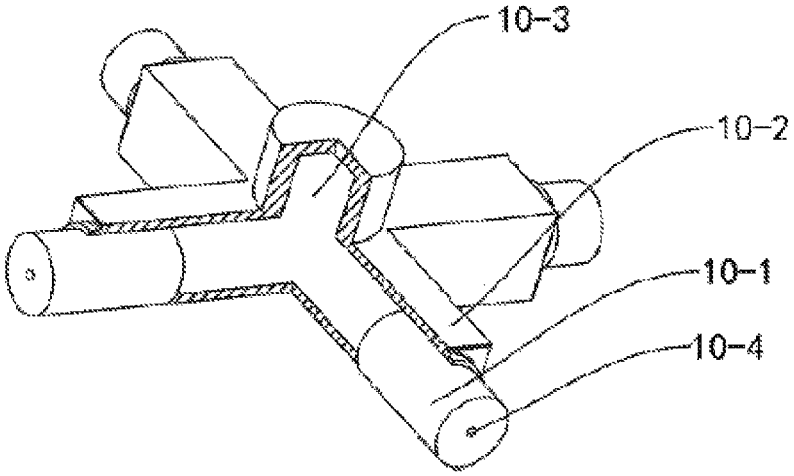
FIG. 14 is a schematic view of a four-way cylinder.
Figure 15:
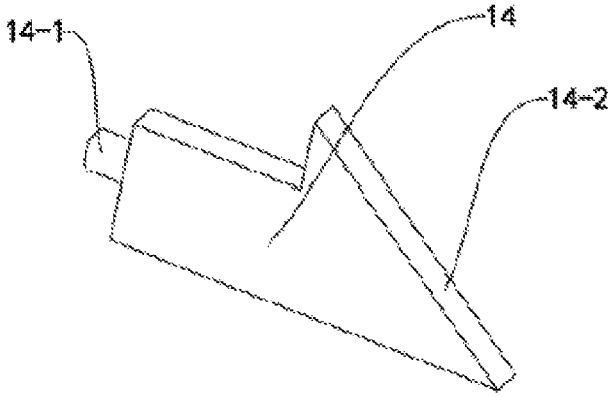
FIG. 15 is a schematic view of a triangular clamping block.
Figure 16:
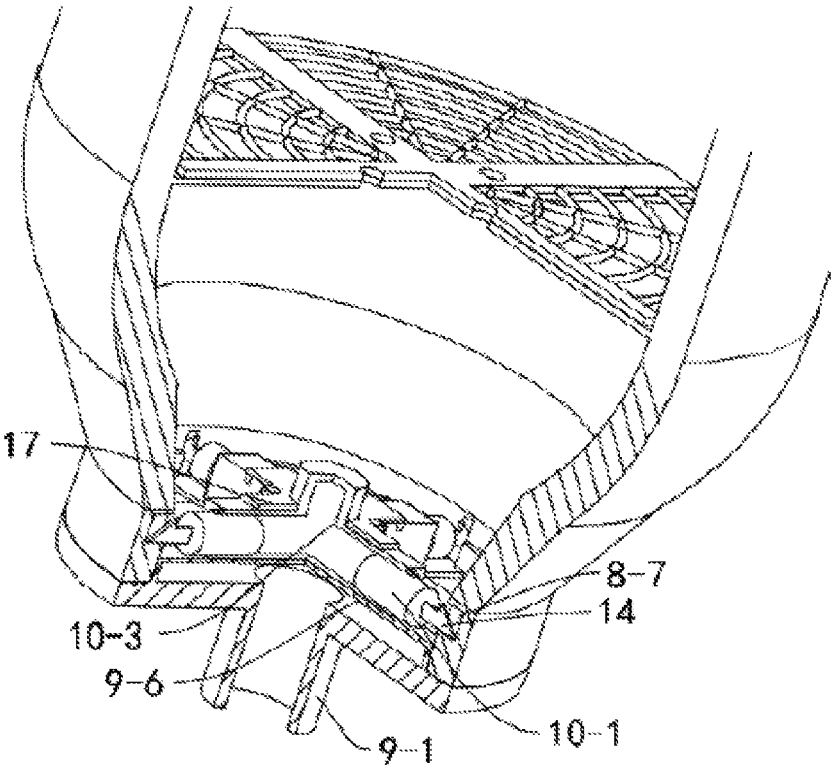
FIG. 16 is an assembly schematic view of a cylinder mechanism and the gas reaction compartment.

As shown in FIGS. 14 and 15, the four-way cylinder 10 has a circumferentially symmetrical shape, and is mainly composed of four first pistons 10-1, four first piston barrels 10-2, a gas chamber 10-3 and a triangular clamp fixing groove 10-4. The four first piston barrels 10-2 are horizontally arranged at equal intervals around the gas chamber 10-3, the first pistons 10-1 are fitted in the first piston barrels 10-2, and the first pistons 10-1 are movable in the first piston barrels 10-2 under a gas pressure of the gas chamber 10-3. An outer wall of the first piston barrel 10-2 is rectangular, the first piston barrel 10-2 is placed on the cylinder bracket 9-6 and is limited by the first limiting block 9-5, and the cylinder frame fixing hole 17-4 of the cylinder frame 17 is in fit with the fixed cylinder column 9-8 to fix the four-way cylinder 10. The triangular clamp fixing groove 10-4 is in fit with a fixing column 14-1 of a triangular clamping block 14 to fix the triangular clamping block 14 to an outer end of the first piston 10-1 and move together therewith. A bevel 14-2 of the triangular clamping block 14 is inserted into the clamping groove 8-7, so that the bottom end cover 9 does not fall off from the bottom sealing port 8-6, and an assembly style thereof is as shown in FIG. 16.

Figure 17:
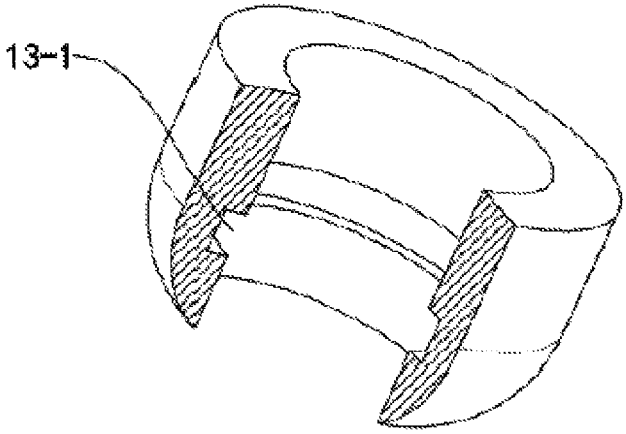
FIG. 17 is a schematic view of a counterweight load.

As shown in FIG. 17, a counterweight load 13 has a cylindrical shape, an inner wall thereof has an annular groove 13-1 with a rectangular cross section, and a lower portion thereof has a round angle shape so as to reduce water resistance in water.

The thrust reversal emergency jettison device for the underwater vehicle according to the present invention is mainly assembled at the bottom of the underwater vehicle to perform jettison and ascending in case of emergency, and provides an upward thrust to prevent the underwater vehicle from being unable to ascending due to obstacles such as sea grass and sediment.

When mounted on the water surface, the thrust reversal emergency jettison device for the underwater vehicle according to the present invention feed metallic sodium onto the isolation mesh 7 in the gas reaction compartment 8. Then the top end cover 5 is hermetically connected with a top of the gas reaction compartment 8, the water outlet of the one-way normally open solenoid valve 3 is connected with the solenoid valve connection port 5-3, and the control line of the one-way normally open solenoid valve 3 is connected with a control mainboard in the underwater vehicle, the one-way normally open solenoid valve 3 is powered on, and the solenoid valve connection port 5-3 is closed.

Figure 18:
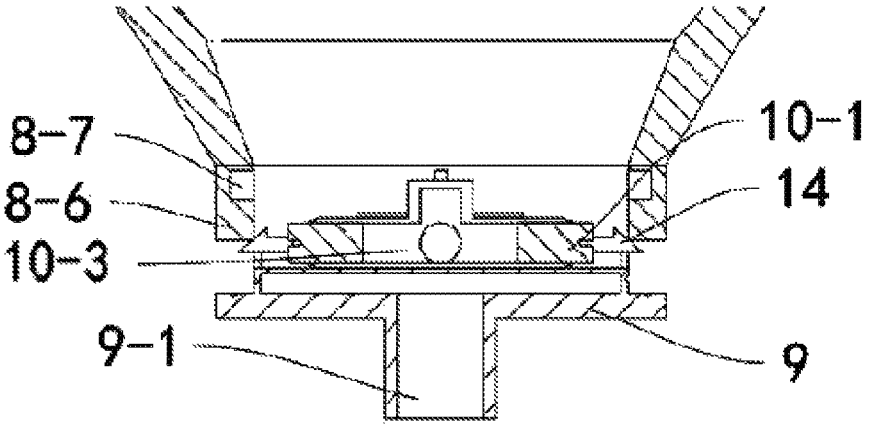
FIG. 18 is a schematic view of a state before the clamping block enters a clamping groove during assembly of the cylinder mechanism and the gas reaction compartment.
Figure 19:
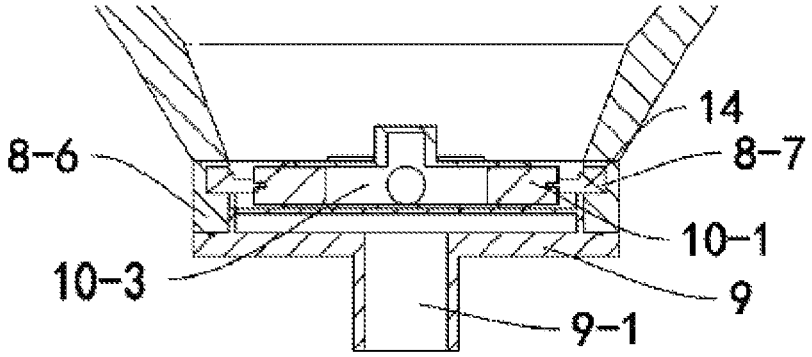
FIG. 19 is a schematic view of a state after the clamping block enters the clamping groove during assembly of the cylinder mechanism and the gas reaction compartment.

Initially, normal atmospheric pressure is present in the four-way cylinder 10 on the cylinder bracket 9-6 of the bottom end cover 9. The bottom end cover 9 is pushed into the bottom sealing port 8-6, and since the triangular clamping block 14 has a bevel 14-2, under compression of the bottom sealing port 8-6, the triangular clamping block 14 moves inwards, and the first piston 10-1 is pressed inwards along the first piston barrel 10-2. When the bottom end cover 9 is pushed to the bottom, the axial sealing ring 9-2 and the radial sealing ring 9-3 complete sealing of the bottom sealing port 8-6, and meanwhile the triangular clamping block 14 is pushed to the clamping groove 8-7. Due to the gas pressure, the first piston 10-1 extends outwards along the first piston barrel 10-2, and the triangular clamping block 14 is inserted into the clamping groove 8-7 to fix the bottom end cover 9 at the bottom sealing port 8-6. The process is shown in FIGS. 18 and 19 respectively.

Figure 20:
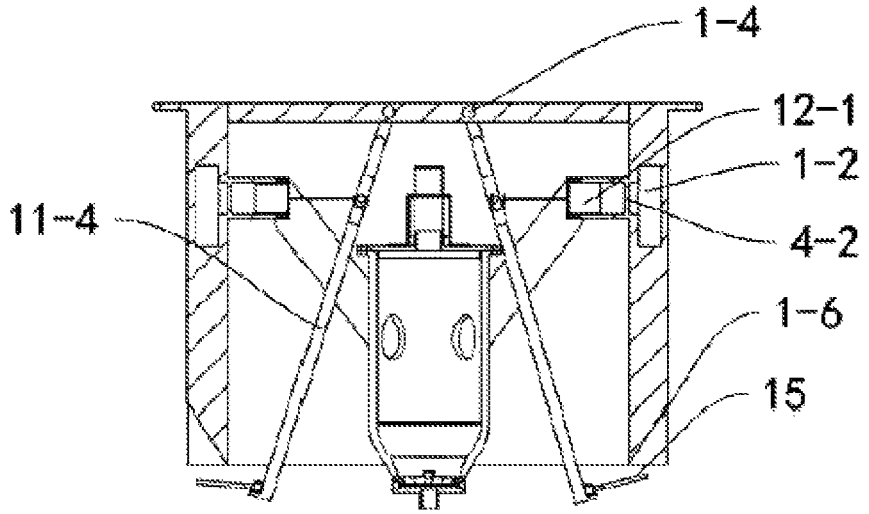
FIG. 20 is a schematic view of a state before the thrust reversal mechanism is assembled with the counterweight load.
Figure 21:
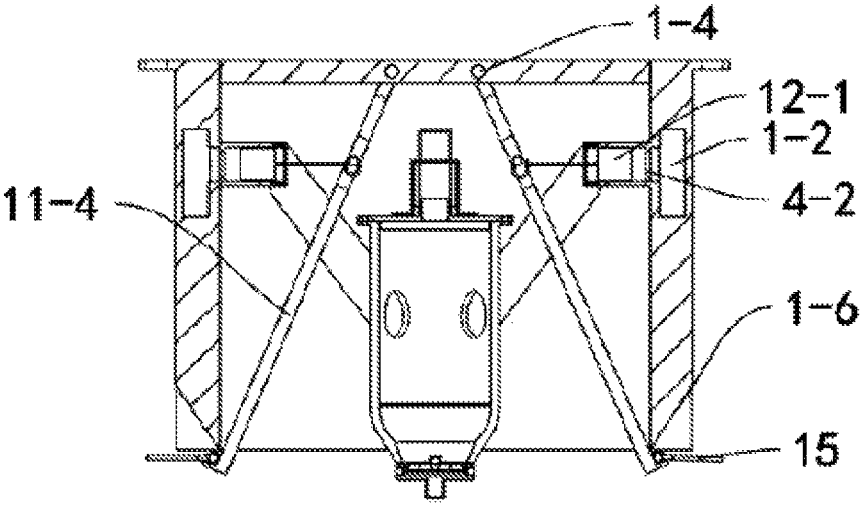
FIG. 21 is a schematic view of a state in which the second piston is retracted before the thrust reversal mechanism is assembled with the counterweight load.

Subsequently, the gas in the gas reaction compartment 8 is drawn out through the one-way valve on the outside of the air hole 9-1. Since the gas pressure in the gas reaction compartment 8 decrease while the gas pressure in the gas compartment 10-3 keeps unchanged, the gas pressure pushes against the first piston 10-1 to move outward along the first piston barrel 10-2, which in turn clamps the triangular clamping block 14 more tightly. Meanwhile, due to the external atmospheric pressure, the bottom end cover 9 is pressed at the bottom sealing port 8-6, and the piston body 12-1 is pushed towards the gas passage 1-2 and is limited by the piston limiting block 4-2. Movement of the piston body 12-1 drives the short connecting rod 12-2 and the snap ring 12-3 to move. The snap ring 12-3 is in fit with the rod body 11-4 through a pin, thereby driving the rod body 11-4 to move. The tail end of the rod body 11-4 is provided with the hook plate 15. Since the hook plate 15 has the magnetic surface 15-2 magnetically the same as the magnetic bevel 1-6 of the triangular chute 1-5, and limited by the limiting baffle 11-6, the hook plate 15 is in an unfolded style, as shown in FIGS. 20 and 21.

Figure 22:
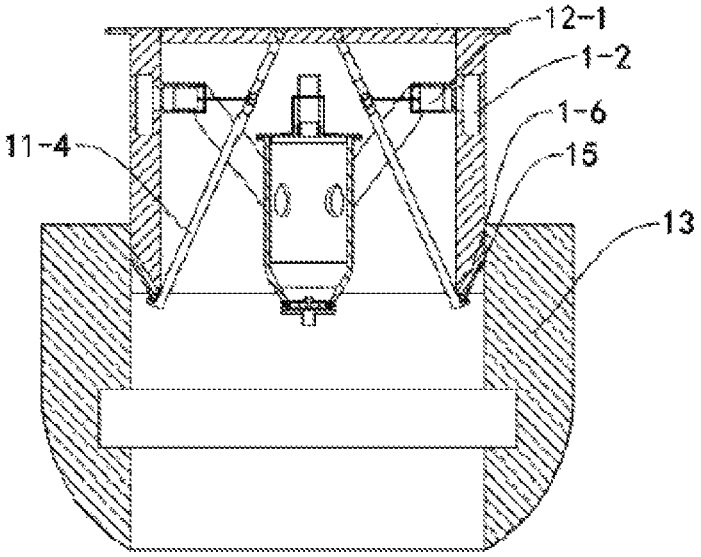
FIG. 22 is a schematic view of an initial state of an assembly process of the thrust reversal mechanism and the counterweight load.
Figure 23:
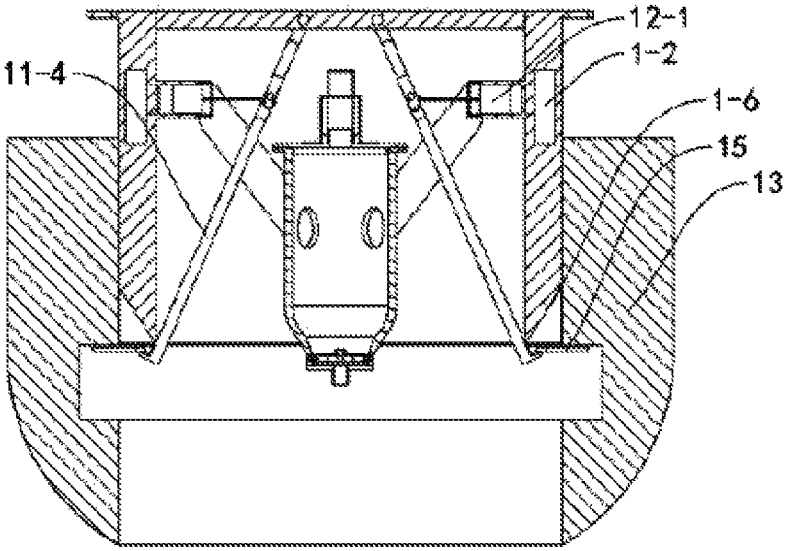
FIG. 23 is a schematic view of a state in which the thrust reversal mechanism is assembled with the counterweight load.

The counterweight load 13 is sleeved on an outside of the casing 1 from bottom to top. The inner wall of the counterweight load 13 first presses the hook plate 15 into the triangular chute 1-5 in a vertical direction, as shown in FIG. 22. When the counterweight load 13 continues to be pushed in, the annular groove 13-1 on the inner wall of the counterweight load 13 provides a movement space for the hook plate 15, so that the hook plate 15 is free. At this point, under the action of two magnetic surfaces repelling each other with the same polarity, the hook plate 15 rotates downwards to be unfolded. Additionally, due to the limiting action of the limiting baffle 11-6, the hook plate 15 extends into the annular groove and hooks the counterweight load 13, as shown in FIG. 23.

The device of the present invention is placed underwater after assembly. Due to water pressure, the bottom end cover 9 is pressed at the bottom sealing port 8-6. When an emergency occurs, the control mainboard in the underwater vehicle disconnects circuits, and the one-way normally open solenoid valve 3 is opened. Since an external water pressure is greater than the gas pressure in the gas reaction compartment 8, seawater enters the gas reaction compartment 8 from the solenoid valve connection port 5-3. Due to presence of a protective layer of sodium oxide on the surface of metallic sodium, reaction between the sodium oxide and the seawater is slightly slow, providing certain time for drawing seawater. When the reaction between the sodium oxide and the seawater completes, the internal sodium reacts violently with the seawater. Due to one-way conductivity of the one-way normally open solenoid valve 3 and sealing of the gas reaction compartment 8 by the bottom end cover 9, the gas pressure in the gas reaction compartment 8 increases rapidly. When the gas pressure in the gas reaction compartment 8 is greater than the external water pressure, the gas pressure in the gas reaction compartment 8 pushes the piston body 12-1 to move outwards. The rod body 11-4 drives the hook plate 15 to move to the middle through linkage of the short connecting rod 12-2, the snap ring 12-3 and the rod body 11-4, and the hook plate 15 gradually disengages from the annular groove of the counterweight load 13. When the hook plate 15 is unable to catch the counterweight load 13, the counterweight load 13 falls due to the force of gravity, achieving jettison.

The pressure in the gas reaction compartment 8 continues to increase, and the gas pressure in the gas compartment 10-3 keeps unchanged, under the action of the external pressure, the first piston 10-1 drives the triangular clamping block 14 to move inwards along the first piston barrel 10-2. When the pressure reaches a certain level, the triangular clamping block 14 is disengaged from the clamping groove 8-7, and the bottom end cover 9 is subject to an inward force of the external water pressure and a friction force of the wall of the compartment, as well as an internal pressure. Since the pressure in the gas reaction compartment 8 is much greater than the external water pressure and the friction force of the wall of the compartment, the bottom end cover 9 is ejected by the internal pressure, the seawater and the high-pressure gas in the gas reaction compartment 8 are accelerated by the bottom constriction port 8-5, and then are ejected from the bottom sealing port 8-6, which generates a reverse thrust that enable the underwater vehicle to get rid of sediment and sea grass, and ascend to the water surface faster.

What is claimed is:

1. A thrust reversal emergency jettison device for an underwater vehicle, comprising a thrust reversal mechanism, wherein the thrust reversal mechanism comprises a casing and a gas reaction compartment provided in the casing; the gas reaction compartment communicates with a gas passage in a shell of the casing through a gas pipe; a bottom end cover is provided at a bottom of the gas reaction compartment, and the bottom end cover is hermetically connected with the gas reaction compartment through a cylinder mechanism, and falls off automatically when a gas pressure in the gas reaction compartment increases; the cylinder mechanism is fixed on the bottom end cover, and comprises a gas chamber and more than two first piston barrels provided circumferentially around the gas chamber; a first piston is provided in the first piston barrel, and a clamping block is connected to an outer end of the first piston; a bottom inner wall of the gas reaction compartment is provided with a clamping groove, and the first piston extends or retracts along the first piston barrel under an action of the gas pressure, thereby connecting/separating the clamping block with/from the clamping groove; a counterweight load is detachably assembled to an outer portion of the thrust reversal mechanism through a piston connecting rod mechanism; the piston connecting rod mechanism comprises a second piston and a second piston barrel, and the second piston barrel is connected with an inner wall of the casing and communicates with the gas passage in the shell of the casing; an outer end of the second piston is connected to a short connecting rod; the other end of the short connecting rod is connected with a long connecting rod, the short connecting rod is shorter than long connecting rod, an upper end of the long connecting rod is fixed by a rotating shaft, and a lower end is provided with a hook plate; and the second piston extends or retracts along the second piston barrel under the action of the gas pressure, thereby driving the long connecting rod to rotate around an axis.

2. The thrust reversal emergency jettison device for an underwater vehicle according to claim 1, wherein an upper end face of the bottom end cover is provided with an annular axial baffle; an outer wall of the annular axial baffle is provided with an axial sealing ring; the upper end face of the bottom end cover is provided with a radial sealing ring, and a middle portion of the bottom end cover is provided with an air hole in communication with the gas reaction compartment; and a cylinder bracket is provided in the annular axial baffle.

3. The thrust reversal emergency jettison device for an underwater vehicle according to claim 1, wherein a top end cover is hermetically connected to a top of the gas reaction compartment; and the top end cover is provided with an opening, and a one-way normally open solenoid valve is mounted at the opening.

4. The thrust reversal emergency jettison device for an underwater vehicle according to claim 1, wherein the hook plate is hinged to the lower end of the long connecting rod; a limiting baffle is provided below the hook plate; a chute with a downward opening is provided at a bottom of the casing; and the hook plate and the chute are respectively provided with magnetic surfaces with a same magnetism, and the hook plate rotates downwards to open under the action of repulsion of the same magnetism.

5. The thrust reversal emergency jettison device for an underwater vehicle according to claim 1, wherein the counterweight load is a shell structure with two open ends, an inner wall thereof is provided with an annular groove, and the counterweight load can be fixed outside of the casing after the hook plate extends into the annular groove.

* * * * *